United States Patent [19]

Shirose et al.

[11] Patent Number: 4,770,969

[45] Date of Patent: Sep. 13, 1988

[54] HEAT FUSIBLE TONERS FOR DEVELOPING ELECTROSTATIC IMAGES

[75] Inventors: Meizo Shirose; Jiro Takahashi; Kenichi Kishi, all of Hachioji; Kiyoshi Tamaki; Akitoshi Matsubara, both of Hino, all of Japan

[73] Assignee: Konishiroku Photo Industry Co., Ltd., Tokyo, Japan

[21] Appl. No.: 71,604

[22] Filed: Jul. 8, 1987

Related U.S. Application Data

[63] Continuation of Ser. No. 906,566, Sep. 8, 1986, abandoned, which is a continuation of Ser. No. 726,189, Apr. 23, 1985, abandoned, which is a continuation of Ser. No. 527,170, Aug. 26, 1983, abandoned.

[30] Foreign Application Priority Data

Aug. 30, 1982 [JP] Japan ..... 57-149052

[51] Int. Cl.[4] ..... G03G 9/00; G03G 13/20; G03G 21/00

[52] U.S. Cl. ..... 430/109; 430/99; 430/124; 430/125

[58] Field of Search ..... 430/109, 99, 124, 125

[56] References Cited

U.S. PATENT DOCUMENTS

| | | | |
|---|---|---|---|
| Re. 31,072 | 11/1982 | Jadwin et al. | 430/109 X |
| 3,655,374 | 4/1972 | Palermitt et al. | 430/124 |
| 3,893,932 | 7/1975 | Azar et al. | 430/109 |
| 3,901,695 | 8/1975 | Shelffo | 430/124 X |
| 3,988,250 | 10/1976 | Sakaguchi et al. | 430/109 |
| 4,229,512 | 10/1980 | Lenhard et al. | 430/124 X |
| 4,288,516 | 9/1981 | Gaudioso | 430/109 X |
| 4,320,714 | 3/1982 | Shimazaki et al. | 430/99 X |
| 4,387,211 | 6/1983 | Yasuda et al. | 528/176 X |
| 4,507,376 | 3/1985 | Makita et al. | 430/109 |
| 4,514,486 | 4/1985 | Shirose et al. | 430/124 |
| 4,565,763 | 1/1986 | Uchiyama et al. | 430/137 |

FOREIGN PATENT DOCUMENTS

| | | | |
|---|---|---|---|
| 0033248 | 8/1981 | European Pat. Off. | 430/109 |
| 2553347 | 7/1976 | Fed. Rep. of Germany | 430/109 |
| 2338520 | 9/1977 | France | 430/109 |
| 0050241 | 4/1977 | Japan | 430/109 |
| 0009153 | 1/1983 | Japan | 430/109 |

*Primary Examiner*—Mukund J. Shah

*Attorney, Agent, or Firm*—Jordan B. Bierman

[57] ABSTRACT

Heat fusible toner for developing an electrostatic latent image comprising a heat fusible binder, a coloring agent, and optionally containing a magnetic substance, wherein the elasticity of the fused toner increases with time as it is kept in the fused state. The binder is preferably a polyester or polyamide obtained by condensing a polyvalent alcohol or amine with polyvalent carboxylic acids. The binder polymer preferably has at least one monomer component with three or more functional groups.

11 Claims, No Drawings

HEAT FUSIBLE TONERS FOR DEVELOPING ELECTROSTATIC IMAGES

This application is a continuation of application Ser. No. 906,566, filed Sept. 8, 1986, now abandoned, which is a continuation of application Ser. No. 726,189, filed Apr. 23, 1985, now abandoned, which is a continuation of application Ser. No. 527,170, filed Aug. 26, 1983, now abandoned.

BACKGROUND OF THE INVENTION

1. Field of the Invention

The invention relates to toners for developing electrostatically charged images formed in an electrophotographic method, an electrostatic printing method, an electrostatic recording method or the like.

2. Description of the State of the Art

A process for developing an electrostatically charged image is that electrically charged fine particles are attracted by means of electrostatic magnetism to adhere them to the surface of an electrostatically charged image support so that the electrostatically charged image can be visualized.

There are two concrete methods for performing such a developing process as mentioned above, i.e., a wet type developing method using a liquid developer in which pigments or dyes are finely dispersed in an insulating organic liquid; and a dry type developing method, such as a cascade method, a fur brush method, a magnetic brush method, an impression method, a powder-cloud method, or the like, which uses a powder developer comprising toners in which a coloring agent such as carbon-black and the like is dispersedly contained in a binder comprising natural or synthetic resins.

An image visualized in a developing process is sometimes fused as it is to a support and is commonly transferred to such a support as a transfer paper and then fused thereto. The toners of this kind are applied not only to a developing process but also to the successive processes, i.e., a transfer process and a fusing process and such toners are therefore required to display such characteristics as an excellent image transferability and an excellent fusibility as well as an excellent developability. Among these characteristics the most strict conditions are required for the fusibility, and accordingly there have been published many literatures and reports on the studies of the improvements on the fusibility of toners and on the results thereof.

Generally speaking, a heat-fusing method is advantageous for fusing a toner image formed in a developing process or a transferred toner image. In these heat-fusing methods, there are a non-contact heat fusing method such as an oven-fusing and the like, and a contact heat-fusing method such as a heat-roller fusing and the like. The contact heat-fusing methods are excellent in the thermal efficiency, and are in particular suitable for a high speed copying apparatus because a rapid fusing is possible in this method. Also in this method, power consumption can be economized because a relatively low heat source may be used, and the miniaturization of a copying apparatus and energy saving can also be provided. Further, there is no danger of fire even if a sheet of paper remains inside of a fusing unit, that is another merit thereof.

Contact heat-fusing methods are the desirable in various aspects as described above, however, there is a problem in the methods that an offset phenomenon will occur. The offset phenomenon stains an image in the manner that a part of toners forming the image is transferred to the surface of a heat-roller when fusing the image and the transferred toners are further transferred to a sheet of transfer paper or the like which is brought in for the next cycle. To prevent the offset phenomenon, there is an effective means in which a cleaning member such as a cleaning roller is brought into contact with a heat-roller to clean up toners adhered to the heat-roller.

However, when providing such cleaning member, the so-called back-stain phenomenon will occur. This back-stain phenomenon is that, when toners piled on a cleaning member are excessively heated, the toners are transferred to a heat-roller and then they stain the surface of an image support such as a transfer paper fed thereafter, and the toners are further transferred to a pressure-contact roller brought into pressure-contact with the heat-roller and thus the back surface of the image support is stained with the toners transferred to the pressure-contact roller.

As the results of investigating the causes of such back-stain phenomenon, it was found that the elasticity of toners being fused will seriously affect to cause this back-stain phenomenon. To be more concrete, a thermoplastic resin of which the principal component is a styrene-acryl copolymer, for example, has so far been used as a binder resin for toners, and the resins of this kind are apt to be transferred because of the less elasticity of the resins when being fused, and therefore, even though the resins are adhered once to a cleaning member, and in the case of using a heater for a heat-roller for example, the resins are transferred to the heat-roller when toner adhered to the cleaning member are heated up, and a back-stain phenomenon is consequently caused.

In contrast with the above, toners of which the elasticity when being fused is so great that a back-stain phenomenon does not occur, are very bad in the fusibility, because the elasticity thereof is still great even when the toners are softened and fused by a heat-roller and also because the wettability thereof to an image support such as transfer paper or the permeability thereof to the gaps between the fibers of paper is small.

The invention has been devised by taking the above-mentioned circumstances into consideration.

STATEMENT OF THE OBJECT OF THE INVENTION

It is therefore a principal object of the invention to provide an electrostatically charged image developing toner with which a fusing process can suitably be made in a contact heat-fusing method and no back-stain phenomenon is caused:

DETAILED DESCRIPTION OF THE INVENTION

The objects of the invention can be achieved by an electrostatically charged image developing toner which is to be fused by heat at a temperature to increase the elasticity thereof at the same temperature with the lapse of time.

The invention will be more concretely described hereafter:

In the invention, there uses, as the binders for toners, for example, a thermal condensation type polymer in which an unreacted functional group remains to be condensedly reacted by heat, i.e., a polymer in which a condensation is partly reacted, and thereby the toners are endowed with such a property that the toners are fused when heating at the temperature of the order of 130° C. to 250° C. for example, and the elasticity thereof in a fused state is increased with the lapse of time under the same condition of the temperature. For example, the toners to be used in the invention comprise polymers to serve as the binders thereof and the elasticity of the polymers is to be 1,000 to 20,000 dyne/cm$^2$ immediately after the toners are fused at the fusing temperature and, when the toners are kept for 60 minutes in the fused state, the elasticity thereof is to be doubled or more and preferably four times or more than that as much as possible and at least 24,000 dyne/cm$^2$ or greater.

The abovementioned elasticity is represented by the modulus value of a dynamic elasticity obtained from the measurement of a dynamic viscoelasticity made by means of a conical disk type rotational viscometer, "Shimazu Rheometer, RM-1, mfd. by Shimazu Seisakusho, Ltd., Japan". The measuring methods and the analytical theories thereof are detailedly described in "Measurement Methods in Rheology", published by Rheology Committee, The Society of Polymer Science, Japan, and "Manual for Shimazu Rheometer RM-1 for measuring a stationary flow viscosity and a dynamic viscoelasticity", and a modulus of dynamic elasticity can be obtained by giving a matter subject to measurement (i.e., a viscoelastic matter) a sinusoidally shearing deformation and then by measuring the shearing stress which has the equivalent period thereto. The measurement of the modulus of a dynamic elasticity in this method is affected by a shearing speed, that is, a number of revolutions of the disk, and the number of revolutions thereof is set at 50 r.p.m.

After the toners of the invention are heatedly fused, as described above, the elasticity thereof increases with the lapse of time under the same temperature condition as they were fused, therefore, such an image support as transfer paper or the like which carries thereon a toner image formed in a developing process is transported to a heat-roller fixing device so as to be fixed, and when the toners forming a tone image are brought into contact with the heat-roller, the toners are then fused. At this time, the elasticity of the fused toners are small and therefore the wettability thereof to the image support is good so that the fused toners satisfactorily permeate between fibers, and resultantly an excellent fixing thereof may be performed. A part of the toners is adhered to the heat-roller and is cleaned by a cleaning-roller, and the toner materials thus accumulated increase their elasticity with the lapse of time on the cleaning-roller, and therefore, even if they are heated higher than the fixing temperature by means of the heat-roller, they do not migrate to a pressure-contact roller through the heat-roller, and it is therefore possible to prevent a back-stain phenomenon.

Accordingly, an excellent fixation can surely be achieved when a toner elasticity is from 1000 to 20,000 dyne/cm$^2$ at the time immediately after fusing, and a back-stain phenomenon is surely preventable when the elasticity of toner materials fused on a cleaning-roller is 24,000 dyne/cm$^2$ or over.

As for the binders of the toners of the invention, a polyester resin obtainable by condensing a polyvalent carboxylic acid and a polyvalent alcohol, a polyamide resin obtainable by condensing a polyvalent carboxylic acid and a polyvalent amine, and the like may preferably be used. In particular, it is desired that the component of at least one of the monomers to be condensed together contains a polyfunctional monomer having not less than three functions in a proportion of 20 to 30 mole % of the component thereof. When a polyester resin is used as a binder, the preferable one is a polyester having the acid value of not lower than 27, preferably not lower than 30, and more preferably not lower than 37.

As for the concrete examples of a dicarboxylic acid capable of being suitably used for preparing a polyester resin or a polyamide resin, there may be given those such as maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, the anhydrides of the abovementioned acids, dimers of a lower alkyl ester and linolenic acid, and the like.

As for the concrete examples of a trivalent or polyvalent carboxylic acid capable of being suitably used, there may be given those such as 1,2,4-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxyl-propane, tetra (methylene carboxyl) methane, 1,2,7,8-octane tetracarboxylic acid, the acids anhydride thereof, and the like.

As for the concrete examples of polyvalent alcohols capable of providing a polyester resin through the condensation with the abovementioned polyvalent carboxylic acid, there may be given a diol such as ethylene glycol, diethylene glycol, triethylene glycol, 1,2-propylene glycol, 1,3-propylene glycol, 1,4-butanediol, neopentyl glycol, 1,4-butenediol, and the like; 1,4-bis(hydroxymethyl)cyclohexane; and an etherified bisphenol such as bisphenol A, hydrogenated bisphenol A, polyoxyethylenated bisphenol A, polyoxypropylenated bisphenol A, and the like.

As for the concrete examples of a polyvalent alcohol having not less than trivalence capable of being suitably used, there may be given those such as solbitol, 1,2,3,6-hexanetetrol, 1,4-solbitan, pentaerythritol, dipentaerythritol, tripentaerythritol, cane sugar, 1,2,4-butanetriol, 1,2,5-pentatriol, glycerol, 2-methyl propane triol, 2-methyl-1,2,4-butanetriol, trimethylol ethane, trimethylol propane, 1,3,5-trihydroxymethyl benzene, and the like.

Further, as for the concrete examples of a polyvalent amine capable of providing a polyamide resin through the condensation with the abovementioned polyvalent carboxylic acid, there may be given those such as ethylenediamine, hexamethylenediamine, iminobispropylamine, phenylenediamine, xylenediamine, 4,4'-diaminophenyl ether, diethylenetriamine, triethylenetetramine, and the like.

In the particles of the toners of the invention, the particles of the binders thereof already described contain a coloring agent and also contain a characteristic improving agent if occasion demands, and when the toners are magnetized, the binders thereof will contain a magnetic substance together with the coloring agents or contain such a magnetic substance in place of the coloring agents.

As for the coloring agents, there may be given those such as carbon black, nigrosine dye (C.I. No. 50415B), aniline blue (C.I. No. 50405), chalcoil blue (C.I. No. azoec Blue 3), chrome yellow (C.I. No. 14090), ultramarine blue (C.I. No. 77103), Du Pont oil red (C.I. No.

26105), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), rose bengal (C.I. No. 45435), the mixtures thereof, and the like. These coloring agents should be contained in the binders in an adequate proportion to form a visible image having a satisfactory density, and such proportion thereof is normally of the order of 1 to 20 parts by weight to 100 parts by weight of the binders.

As for the aforementioned magnetic substances, there may be given those such as a ferromagnetic metal or alloy, e.g., cobalt and nickel as well as ferrite and magnetite; a compound containing the abovementioned elements; an alloy not containing any ferromagnetic element but exhibiting a ferromagnetism through the application of a heat treatment, e.g., a group of an alloy that is so-called a Heusler's alloy containing manganese and copper, i.e., manganese-copper-aluminium alloy, manganese-copper-tin alloy or the like; chromium dioxide; and the like. These magnetic substances are evenly dispersed in the form of fine powders of which the average particle size is 0.1 to 1 micron, in the binders. The contents thereof are 20 to 70 parts by weight to 100 parts by weight of the toners, and preferably 40 to 70 parts by weight.

The following examples are intended to illustrate the invention and are not to be construed to limit the scope of the invention. In the illustration thereof, the words, "part" and "parts" are expressed as "part by weight" and "parts by weight" respectively, unless otherwise stated.

[SYNTHESIS EXAMPLE 1]

Terephthalic acid of 91 g, 490 g of polyoxypropylenated bisphenol A and 200 g of polyoxyethylenated bisphenol A were heated under nitrogen flow, and 0.05 g of dibutyl stannic oxide were added thereto, and then the reaction thereof was made with keeping the temperature at 200° C. Thereafter, the reactant was added by 161 g of anhydrous 1,2,4-benzenetricarboxylic acid to be further reacted. The progress of the reaction was traced at the softening point by means of a Koka flow-tester, and the reaction was stopped when the softening point of the polymer created reached 132° C., and was then cooled to room temperature, and thus resin A was synthesized. The resin A was dissolved in dioxane, and the titration was made by an alcoholic potassium hydroxide solution with phenolphthalein as the indicator. When measuring the acid value of the resin A by making use of the number of m g of potassium hydroxide that is necessary for neutralizing 1 g of the resin A, the acid value thereof was 37.

[SYNTHESIS EXAMPLE 2]

By making use of 700 g of polyoxypropylenated bisphenol A, 95 g of isophthalic acid and 158 g of anhydrous 1,2,4-benzenetricarboxylic acid, the reaction was made in the similar manner to that taken in Synthesis Example 1 and was then stopped when the softening point reached 135° C., and thus resin B was synthesized. The measurement result of the acid value thereof was 31.

EXAMPLE 1

Toners of the invention were prepared in such a manner that 100 parts of resin A, 10 parts of carbon black and 3 parts of polypropylene, "Viscol 660P", (mfd. by Sanyo Chemical Ind. Co., Ltd., Japan) were mixed and the mixture thereof was applied in such an ordinary toner preparation process as heat-kneading, cooling, pulverizing, and classifying at prescribed temperature by means of an extruder. The softening point of this toner was 127° C.

The elasticity of this toner was measured by means of a "Shimazu Rheometer, RM 1" and resultantly, it was 2300 dyne/cm$^2$ at 190° C., then it was 80,000 dyne/cm$^2$ to stand for 60 minutes, that was increased by about 35 times.

The mixture of 5 parts of the toners of the invention and 95 parts of iron powders was made to prepare a developer, and a copy test was tried by making use of the developer in a serial operation for 10,000 copies. To be more concrete, a copying test was tried for 10,000 copy operations by setting the temperature of a heat-roller at 190° C. by means of an electrophotographic copying apparatus, "U-Bix V" (mfd. by Konishiroku Photo Ind. Co., Ltd., Japan) equipped with a fixing unit comprising the heat-roller of which the surface was made of Teflon (mfd. by Du Pont; polytetrafluoroethylene]and a pressure-contact roller of which the surface was made of silicone rubber, "KE 1300RTV" (mfd. by Shinetsu Chemical Co., Ltd., Japan) and having a cleaning roller of which the surface was made of an aromatic nylon non-woven fabric, "No Mex" (mfd. by Du Pont). Resultantly, there was no stain observed on both sides of every copy.

When checking every result of the fixation obtained by variously changing the temperature of the heat-roller, the lowest temperature capable of fixing was 150° C.

EXAMPLE 2

The toners of the invention were prepared in the similar manner to that taken in Example 1, except that the resin B was used herein. The softening point thereof was 129° C. When the elasticity thereof was measured by means of a "Shimazu Rheometer, RM-1", it was 4200 dyne/cm$^2$ at 190° C., and then 82,000 dyne/cm$^2$ after allowing to stand at 210° C. for 60 minutes, that was increased by about 20 times.

The copying test similar to that in Example 1 was tried and wherein there was no stain observed on both surfaces of every copy. The lowest temperature capable of copying was 170° C.

CONTROL EXAMPLE

The toners for control was prepared in a similar manner to that in Example 1, except that, in place of resin A, styrenemethylmethacrylate-butylmethacrylate copolymer was used, of which the proportion by weight of styrene, methylmethacrylate and butylmethacrylate were 5:2:3; the weight average molecular weight $M_W$ was 97,000; the ratio $M_W/Mn$ of the weight average molecular weight $M_W$ to the number average molecular weight Mn was 10.2; and the softening point was 130° C.

The elasticity of the control toner was measured by means of a "Shimazu Rheometer, RM-1" and resultantly, it was 4100 dyne/cm$^2$ at 190° C., and then, 4000 dyne/cm$^2$ even after allowing to stand at 210° C. for 60 minutes, and there was no increase of the elasticity.

From the result of copying test tried in a 10000 copy operation, stains were observed on the back of every copy from the early stage of the operations. The lowest temperature capable of fixing was 170° C.

As illustrated above, it is possible according to the invention, to perform an excellent fixation without fail and to prevent a back-stain phenomenon also without fail.

What is claimed is:

1. A process of fixing a toner image on a sheet bearing said toner image comprising passing said sheet in contact with a heated fixing roller equipped with a cleaning member, said toner image consisting essentially of a toner which comprises polyester resin as a heat-fusible binder, a coloring agent and optionally a magnetic substance, said toner having elasticity which increases in the fused state with passage of time.

2. A process of fixing a toner image as claimed in claim 1, wherein the elasticity of the fused substance of said toner is 1,000 to 20,000 dyne/cm$^2$ immediately after said toner is fused and at least 24,000 dyne cm$^2$ when leaving as it is in a fused state for 60 minutes.

3. A process of fixing a toner image as claimed in claim 1, wherein the elasticity of the fused substance of said toner is at least doubled when said fused substance is left in a fused state for sixty minutes.

4. A process of fixing a toner image as claimed in claim 1, wherein said heat-fusible binder is a polyester resin obtainable by condensing a polyvalent carboxylic acid and a polyvalent alcohol.

5. A process of fixing a toner image as claimed in claim 1, wherein said heat-fusible binder contains a coloring agent in an amount of 1 to 20 parts by weight per 100 parts by weight of said binder.

6. A process of fixing a toner image as claimed in claim 1, wherein said toner contains a magnetic substance in an amount of 20 to 70 parts by weight per 100 parts by weight of said toner.

7. A process of fixing a toner image as claimed in claim 1, wherein said cleaning member is a cleaning roller.

8. A process of fixing a toner image as claimed in claim 4, wherein said polyester resin has an acid value of not less than 27.

9. A process of fixing a toner image as claimed in claim 4, wherein said polyester resin is a condensed product comprising terephthalic acid, polyoxypropylenated bisphenol A, polyoxyethylenated bisphenol A and anhydrous 1,2,4-benzentricarboxylic acid.

10. A process of fixing a toner image as claimed in claim 4, wherein said polyester resin is a condensed product comprising polyoxypropylenated bisphenol A, isophthalic acid, and 1,2 4-benzentricarboxylic acid anhydrated.

11. The process of claim 4 wherein said toner further comprises polypropylene.

* * * * *